United States Patent [19]

Clark

[11] Patent Number: 5,005,239

[45] Date of Patent: Apr. 9, 1991

[54] BED SHEET SECURING SYSTEM FOR WATERBEDS

[76] Inventor: Debra Clark, Oro Station, Box 2, Unit 1, Ontario, Canada, L0L 2E8

[21] Appl. No.: 570,873

[22] Filed: Aug. 22, 1990

[51] Int. Cl.[5] ..... A47G 9/04

[52] U.S. Cl. ..... 5/451; 5/496; 5/498; 24/72.5

[58] Field of Search ..... 5/451, 400, 496, 498, 5/450, 452, 508; 24/72.5

[56] References Cited

U.S. PATENT DOCUMENTS

| | | | |
|---|---|---|---|
| 4,089,075 | 5/1978 | May | 24/67.5 |
| 4,395,797 | 8/1983 | May | 5/451 |
| 4,486,909 | 12/1984 | McKneelen | 5/451 |
| 4,731,892 | 3/1988 | Bissel | 5/498 |

*Primary Examiner*—Alexander Grosz
*Attorney, Agent, or Firm*—David W. Wong

[57] ABSTRACT

A system for securing a bed sheet to a waterbed is shown. The system consists of eight hook-shaped brackets and a flat sheet having resilient loops provided at its corners. A pair of the brackets are provided at each adjacent corners of the bed frame of the waterbed and positioned just above the mattress and below the rail caps. The sheet can be quickly and easily secured to the brackets by pushing the resilient loops of the sheet towards the bed frame corners until they engage with the associated brackets to secure the sheet in place over the mattress. The sheet is retained in place and it is independent of any inherent movements in the mattress during use.

10 Claims, 3 Drawing Sheets

BED SHEET SECURING SYSTEM FOR WATERBEDS

BACKGROUND OF THE INVENTION

This invention relates to a system for securing or attaching a bed sheet to a waterbed.

In waterbeds, due to the inherent internal wave-like motion of the water content within the mattress during use, it is difficult to retain the bed sheet over the mattress. The wave-like motion can dislodge the bed sheet from the mattress readily. Heretofore, attempts have been made to provide various arrangements for attaching a bed sheet securely to the waterbed mattress; however, many of such known arrangements either are too complex in construction or are not satisfactory in function during use. In one known arrangement, a long loose strap is provided at each corner of the bed sheet. The sheet is secured to the mattress by lifting the corners of the heavy water-filled mattress and pulling the straps under each corner one by one and letting the mattress to fall back into the bed frame. Due to the heavy weight of the water-filled mattress such operation is strenuous and awkward to carry out. Yet despite of the diffulty of attaching the bed sheet to the waterbed mattress in such an awkward manner it still can unintentionally and annoyingly separate from the mattress quite readily because of the nature of the waterbed in which the wave-like motion allows varying degrees of shifting and/or movement of the mattress.

Another known method of securing a bed sheet to the waterbed mattress is to provide fastening devices at the corners of the mattress or along the sides thereof. The fastening devices are either directly incorporated on the mattress or provided on long straps which are located underneath the mattress and with their ends extending upwards to locate at the corners of the mattress. The heavy weight of the mattress is utilized to maintain the straps in place. Associated fasteners are then incorporated at the corners of the bed sheet so that the sheet can be quickly and easily mounted in place by the engagement of the associated fastener of the sheet with the fasteners provided on the mattress. Such method provides ease of securing the sheet to the mattress; however, in the case of incorporating the fasteners to the mattress, it requires constructional modification to the latter; and in the case of using long straps, it is again necessary to lift the heavy water-filled mattress to locate such straps thereunder. Moreover, since in such arrangement, commonly the bed sheet is secured to the mattress by four fasteners provided at small areas of the four corners of the bed sheet, the force exerted on the sheet during use is concentrated at these small areas. Since the bed sheet is made of relatively non-resilient fabric, such force can cause the fabric of the sheet to tear readily at the locations of the fasteners in a very short period of time in use. Furthermore, the above methods do not take into consideration of the rail caps provided along the top of the bed frame, which can render access to these devices rather difficult.

SUMMARY OF THE INVENTION

It is the primary object of the present invention to provide a system for securing a bed sheet to the waterbed in which the bed sheet is independent of the movements of the mattress.

It is another object of the present invention to provide a system in which the bed sheet can be easily and quickly secured in place without having to lift the heavy water-filled mattress.

Another object of the present invention is to provide a system which can be simply and easily incorporated in an existing waterbed bed.

It is yet another object of the present invention to provide a system which is simple in structure and is inexpensive to produce.

The system according to the present invention comprises providing four pairs of bracket members at each adjacent side of the four corners of the bed frame. The bracket members have a flat body portion facing or abutting the top surface of the mattress and have a hook-shaped free ends extending outwards from the bed frame and upwards from the mattress. The bed sheet member of the system is provided with resilient loop shaped corner portions which are operatively engageable with the hook-shaped free ends of the bracket members for retaining the bed sheet just above the mattress.

DETAILED DESCRIPTION OF THE PREFERRED EMBODIMENTS

Figure 1:
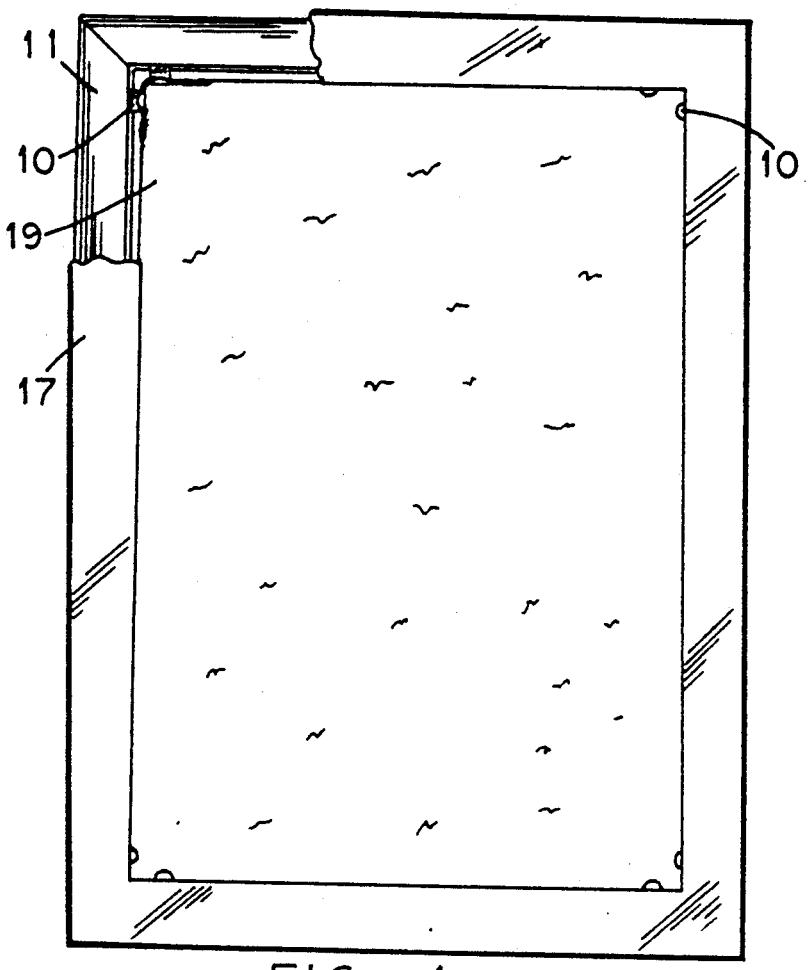
FIG. 1 is a perspective top elevation of a waterbed having a corner of the rail cap cut out to show the location of the mounting brackets and the attachment of the resilient loop of the bed sheet thereto according to the present invention.
Figure 2:
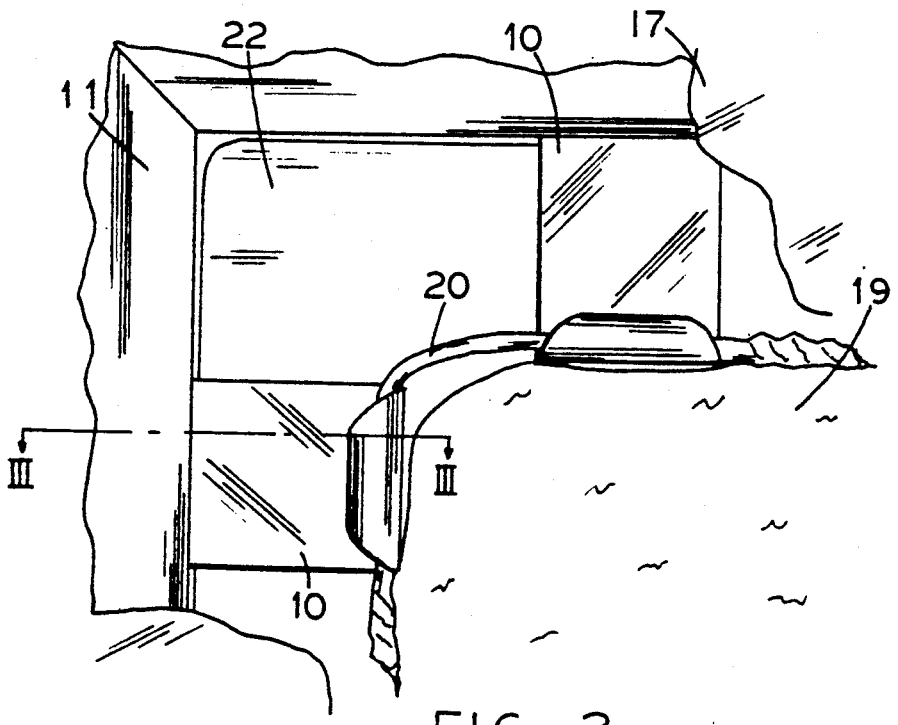
FIG. 2 is an enlarged isolated view of the corner of the bed frame of FIG. 1.
Figure 3:
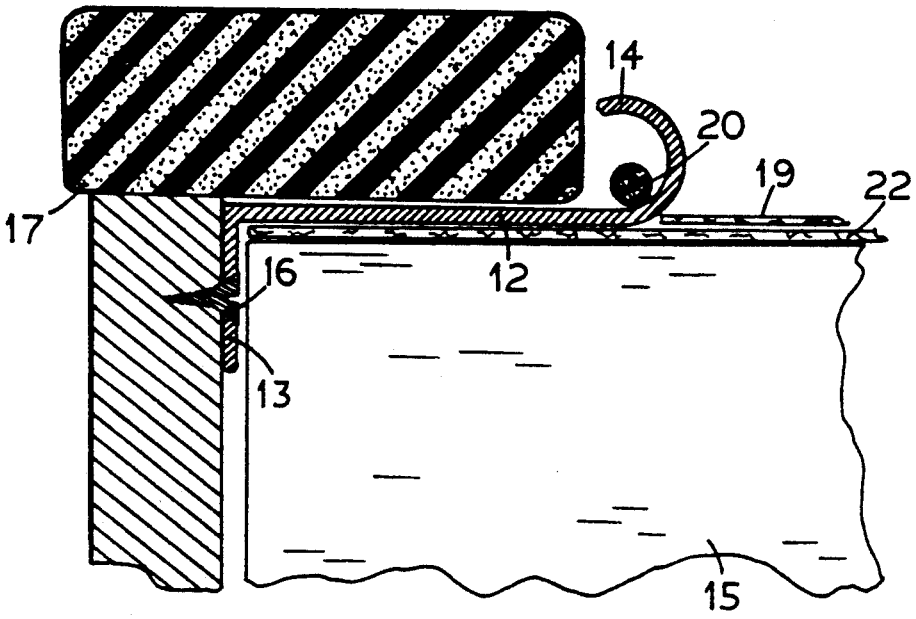
FIG. 3 is a sectional side view along section line III—III of FIG. 2.
Figure 4:
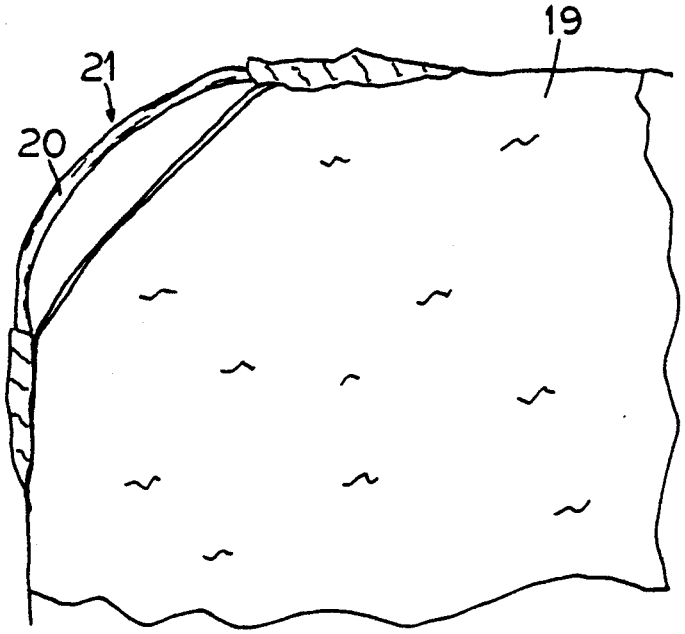
FIG. 4 is an isolated top elevation view of the corner of the bed sheet according to the present invention.
Figure 6:
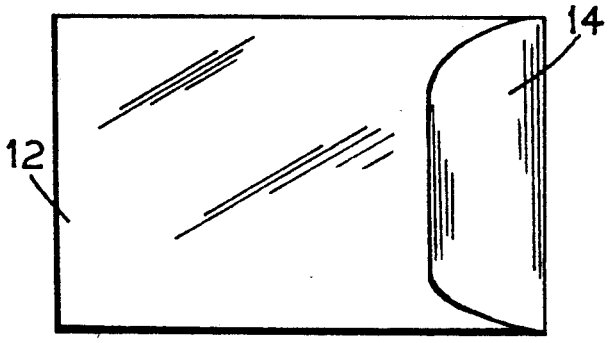
FIG. 6 is a top elevation view of the mounting bracket.
Figure 5:
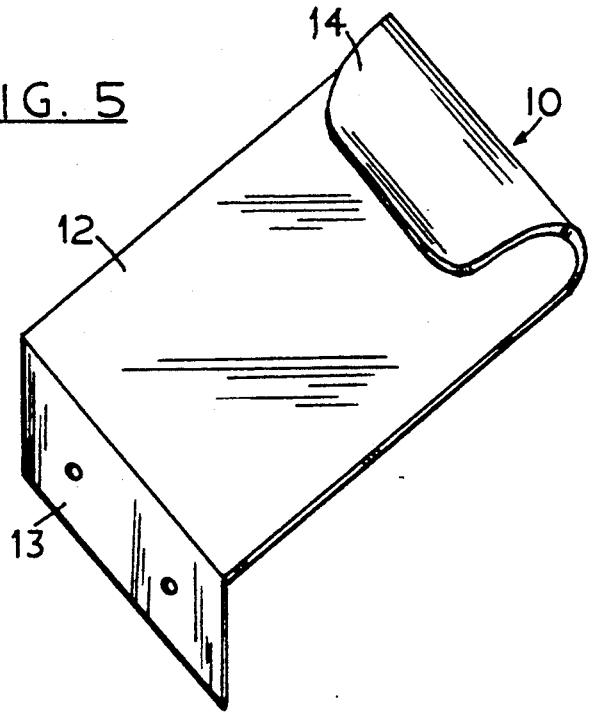
FIG. 5 is a perspective view of the mounting bracket according to the present invention.
Figure 7:
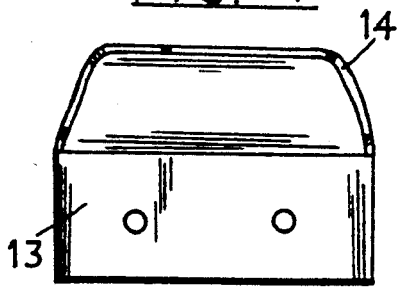
FIG. 7 is an end elevation view of the mounting bracket.

With reference to the drawings wherein like reference numerals designate corresponding parts in the several views, mounting brackets 10 are incorporated at the corners of the bed frame 11 of the waterbed. A pair of the mounting bracket 10 may be provided at each corner of the bed frame such that one mounting bracket 10 is located at each adjacent side of a corner as best shown in FIG. 1. The mounting bracket 10 has a flat body portion 12, a mounting portion 13 extending downwardly in a substantially perpendicular manner from one end of the body portion, and a hook-shaped front end portion 14 extending upwardly from the front end opposite to the mounting portion 13. The mounting bracket 10 may be positioned just above the waterbed mattress 15 with its flat body portion 12 either adjacent to or abutting the top surface of the mattress 15. The brackets 10 may be secured to the bed frame 11 by screws 16 through the mounting portion 13 of the brackets such that the hook-shaped portion 14 of the brackets extend outwards in a cantilever manner from the bed frame 11. Once the mounting brackets 10 have been installed, the rail caps 17 may be replaced onto the bed frame 11, so that normally the only the hook-shaped end portion 14 of the mounting brackets 10 are visible on the bed frame.

The bed sheet 18 of the present invention comprises a flat sheet 19 made of the well known bed sheet material. A resilient strip 20 such as an elastic band is incorporated at the four corners of the sheet 19. The resilient strip 20 may be provided by first cutting away a triangular shaped piece of the fabric from the sheet 19 to form an oblique edge at the open corners and the open corners are then hemmed. The resilient strip 20 is stitched and gathered at each open corner so that a resilient loop 21 is formed by the resilient strip 20 spanning each corner of the sheet 19 and is encased by the fabric to match the remaining area of the sheet.

In use, to secure the bed sheet 18 on the bed, it is merely necessary to spread the sheet 18 over the mattress 15 and then to urge and expand each loop 21, in turn, towards the corresponding corner of the bed frame 11 until the loops 21 engage with the hook-shaped portion of the associated mounting brackets 10. The bed sheet 18 can be simply and easily secured in the above manner. Once secured, the bed sheet 18 will dispose over the mattress 15 and is held in place by the cooperation between the resilient loops 21 and the mounting bracket 10. Since the bed sheet 18 is, in fact, not attached to the mattress 15 it is independent of the movements in the mattress 15. The resilient loops 21 allow for the movements of the bed sheet 18 when a person is sitting or lying on it over the mattress 15. Thus the bed sheet 18 is not subject to tearing at the securing corners, and the resiliency of the loops 21 ensures that they are engaged with the mounting bracket 10 securely without becoming dislodged when the sheet is subject of shifting forces during use. A mattress pad 22 may be provided on top of the mattress 15. The mattress pad 22 will not shift out of position when a force is exerted on the bed sheet due to that it is also independent of the movement of the bed sheet 18.

The mounting bracket 10 and the bed sheet 18 have such simple structure which lend themselves to ease in manufacture, and the bracket 10 can be easily and simply installed to the bed frame 12 without having to lift the heavy water-filled mattress 15 from the bed frame 11.

The bracket 10 may be made of sheet metal or plastic sheet material; and particularly when it is made of sheet metal, it may be coated with a plastic or rubber-like coating material in order to eliminate any sharp edges therein so that it will not cause accidental damage to the mattress and would not cause personal damage to the user contacting the bracket during use.

Obviously, numerous modifications and variations of the present invention are possible in light of the above teachings. It is therefore to be understood that within the scope of the appended claims, the invention may be practiced otherwise than as specifically described herein.

What is claimed is:

1. A bed sheet securing system for a waterbed having a waterbed mattress disposed within a bed frame, comprising a plurality of bracket members mounted on said bed frame, said bracket members having a flat, generally horizontal, surface portion located adjacent to a top surface of said mattress and a hook-shaped free end extending outwards from said bed frame, a bed sheet member having a plurality of resilient loop shaped edge portions operative to engage with said bracket members on said bed frame for retaining said bed sheet member in a mounted position over said mattress, whereby the peripheral edge portions of the bed sheet are located generally above the mattress.

2. A bed sheet securing system according to claim 1 wherein said bed frame has four corners formed by four adjacent sides and one of said bracket members is mounted at each adjacent side of said corners of said bed frame.

3. A bed sheet securing system according to claim 2 wherein said resilient loop shaped edge portions of said bed sheet member comprises an elastic strip means provided at four corners of said bed sheet member.

4. A bed sheet securing system according to claim 3 wherein said bed sheet member has four oblique corners formed by cutting a triangular piece out of said bed sheet member, said oblique corners having a hemmed edge, and said elastic strip means being stitched to end portions of said hemmed edge.

5. A bed sheet securing system according to claim 4 including rail cap means provided over top edges of said bed frame, and said bracket members being disposed below said rail cap means.

6. A bed sheet securing system for a waterbed having a water-filled mattress disposed within a substantially rectangular bed frame having four corners therein formed by four adjacent sides, comprising four pairs of bracket members mounted at said four corners with one bracket member located at each adjacent side of said bed frame, said bracket member having a flat, generally horizontal, body portion, a mounting portion extending perpendicularly at one end edge of said bracket member, and a hook-shaped second end edge portion located opposite to said one end edge and extending substantially upwards from said flat body portion, said bracket member being operatively mounted to said bed frame through said mounting portion and said hook-shaped edge portion extending in a cantilever manner outwardly and upwardly from said bed frame, a flat bed sheet member having four resilient loop shaped corner portions operative to engage with said hook-shaped edge portion of said bracket members for retaining said bed sheet member in a spread out manner over said mattress independent of movements of said mattress within said bed frame whereby the peripheral edge portions of the bed sheet are located generally above the mattress.

7. A bed sheet securing system according to claim 6 wherein said bracket members are disposed over said mattress with said flat body portion disposed adjacent to the top surface of said mattress.

8. A bed sheet securing system according to claim 7 wherein said bed sheet member are made of a fabric material and said bed sheet member has four oblique corners formed by cutting away a triangular portion of therein, said oblique corners having a hemmed edge.

9. A bed sheet securing system according to claim 6 wherein said resilient loop-shaped corner portions of said bed sheet member comprises an elastic strip means stitched to two end portions of said hemmed edge of said four oblique corners.

10. A bed sheet securing system according to claim 9 wherein said elastic strip means is encased in same fabric material of said bed sheet member.

* * * * *